US005805128A

United States Patent [19]

Kim et al.

[11] Patent Number: 5,805,128

[45] Date of Patent: Sep. 8, 1998

[54] LIQUID CRYSTAL DISPLAY DEVICE

[75] Inventors: Dong-Gyu Kim, Suwon-si; Sang-Soo Kim, Seoul, both of Rep. of Korea

[73] Assignee: Samsung Electronics Co., Ltd., Kyungki-do, Rep. of Korea

[21] Appl. No.: 702,158

[22] Filed: Aug. 23, 1996

[30] Foreign Application Priority Data

Aug. 23, 1995 [KR] Rep. of Korea ..... 95-26166

[51] Int. Cl.[6] ..... G09G 3/30

[52] U.S. Cl. ..... 345/96; 345/92

[58] Field of Search ..... 345/50, 54, 55, 345/58, 87, 89, 94, 96, 93, 100, 103, 92

[56] References Cited

U.S. PATENT DOCUMENTS 4,842,371 6/1989 Yasuda et al. ..... 345/107
5,250,937 10/1993 Kikuo et al. ..... 345/89

*Primary Examiner*—Matthew Luu
*Attorney, Agent, or Firm*—Cushman Darby&Cushman IP Group of Pillsbury Madison & Sutro LLP

[57] ABSTRACT

A liquid crystal display device includes a plurality of pixels arrayed in a matrix, and a plurality of data drivers for transmitting a video signal to the pixels. Pixels in the same row receive the video signal from one of the data drivers, while pixels in the adjacent row receive the signal having an opposite data polarity with respect to the same gray level from a different data driver.

3 Claims, 3 Drawing Sheets

LIQUID CRYSTAL DISPLAY DEVICE

BACKGROUND OF THE INVENTION

1. Field of the Invention

The present invention relates to a liquid crystal display (LCD) device, and more particularly, to a liquid crystal display using a gate line inversion driving technique which reduces horizontal crosstalk and power consumption.

2. Description of the Related Art

Many devices use liquid crystal displays, such as portable personal computers. These devices optimally include components which consume as little power as possible, so that they can be used as long as possible per battery charge.

Conventional liquid crystal displays commonly require high voltage drive ICs, which in turn require high power consumption. This inhibits their use in such devices as portable computers, because of their drawback in causing a short duration of usage per battery charge. Therefore, it is desirable to use low voltage ICs in the range of 5 V or less in liquid crystal displays. These components also enjoy other advantages such as easier fabrication and lower price as compared to high voltage drive ICs.

A conventional liquid crystal display, in general, includes: a thin-film transistor (TFT) board, wherein a plurality of pixel units, each including a thin-film transistor, a pixel electrode, and storage capacitors, are arrayed in matrix form, and wherein gate lines and data lines are respectively provided along each row and column of pixels; a color filter plate formed by a color filter and a common electrode; and liquid crystal material which is infused into the space between the thin-film transistor board and the color filter plate.

FIG. 1 illustrates an equivalent circuit diagram of one pixel according to a conventional liquid crystal display. As shown, a liquid crystal capacitor ($C_{lc}$) is formed by a common electrode 2 of a color filter plate, a pixel electrode of a thin-film transistor 5, and the liquid crystal material (not shown) infused into the space therebetween.

The liquid crystal capacitor ($C_{lc}$) is connected between a drain electrode 52 of thin-film transistor 5 and the common electrode 2. Source electrode 51 of thin-film transistor 5 is connected with data line 4 and gate electrode 53 is connected with gate line 3.

One end of a storage capacitor ($C_s$) is connected to a drain electrode 52 of the thin-film transistor 5. Furthermore, a capacitor ($C_{dc}$) is formed between the common electrode 2 of the color filter and the data line 4 of the thin-film transistor 5 having liquid crystal as a medium therebetween.

In a conventional LCD as illustrated in FIG. 2, pixels 6 in the same row are commonly connected with a gate driver 16 through gate line 3, while pixels 6 in the same column are commonly connected with data drivers 8 and 12 through data line 4. The two data drivers 8 and 12, however, are oppositely arranged such that the first data driver 8 is connected with the pixels of each jth (j=1, 3, 5, . . . ) column and the second data driver 12 is connected with the pixels of each (j+1)th column.

The conventional LCD device described above operates as follows, with reference to FIG. 3 and FIG. 4.

A gate driver 16 transmits gate voltage to each gate line 3 in a consecutive manner such that a data voltage can be selectively applied to each of the pixels 6 in each row one by one in order. Then, the data drivers 8 and 12 transmit the data voltage to the pixels 6 in each row in accordance to the operation of the gate driver 16.

In this conventional drive method, the polarity of the data voltage (Vd) supplied to each adjacent row of pixels 6 should be opposite. That is, the polarity of the data voltages corresponding to black and white data is reversed for each adjacent row of pixels 6. Therefore, as shown in FIG. 3, according to a conventional operation, the common electrode voltage (Vcom) supplied to common electrode has an inverse waveform to that of the data voltage (Vd) representing black data supplied to a column of pixels.

This gate line inversion drive operation is more commonly used than a frame inversion drive operation because it causes less flickering of the display. However, the conventional drive method described above suffers from the following problems.

As illustrated in FIG. 3, the common electrode voltage (Vcom) swings in opposite direction of the data voltage (Vd) when the data voltage (Vd) applied by the data drivers 8 and 12 is black data. However, the common electrode voltage (Vcom) is deflected toward the data voltage (Vd) due to the effects of the data voltage (Vd) and capacitive coupling, thereby generating an RC-type delay in the common electrode voltage (Vcom).

Meanwhile, when the data voltage (Vd) of the data drivers 8 and 12 represents white data, as illustrated in FIG. 4, the common electrode voltage (Vcom) swings correspondingly the data voltage (Vd). In this case, the common electrode voltage (Vcom) is deflected toward the data voltage (Vd) due to the effect of the data voltage (Vd) and the capacitive coupling, thereby generating a resistance delay in the common electrode voltage (Vcom).

Moreover, the relative dielectric constant of the liquid crystal material increases in proportion to the voltage difference between data voltage (Vd) and common electrode voltage (Vcom), thereby resulting in a difference in capacitive coupling between that arising from the transmission of black data and that from white data. This is the major cause of horizontal crosstalk occurring during the inversion drive of the gate lines.

SUMMARY OF THE INVENTION

It is, therefore, an object of the present invention to provide a liquid crystal display device that can eliminate horizontal crosstalk in a display using a gate-line inversion drive technique.

It is a further object of the present invention to provide a liquid crystal device which requires a driving voltage lower than 5 V to effect a reduced power consumption.

In order to achieve these and other objects, an embodiment according to the present invention includes a plurality of pixels arrayed in a matrix, and a plurality of data drivers for transmitting a video signal to the pixels, wherein pixels in the same row receive the video signal from one of the data drivers, while pixels in the adjacent row receive the signal from a different data driver.

BRIEF DESCRIPTION OF THE DRAWINGS

These and other advantages of the present invention will become better understood by the following detailed description taken in conjunction with the accompanying drawings in which.

DETAILED DESCRIPTION OF THE PREFERRED EMBODIMENTS

With reference to the annexed drawings, a preferred embodiment of the present invention will now be described in detail as follows.

Figure 1:
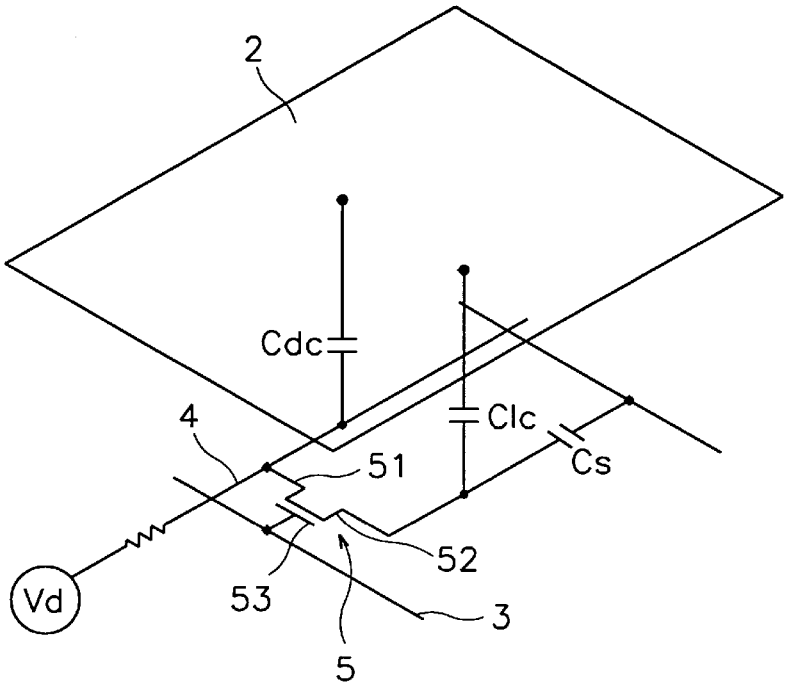
FIG. 1 (Prior Art)
FIG. 1 shows an equivalent circuit diagram of one pixel in a conventional liquid crystal display device.
Figure 2:
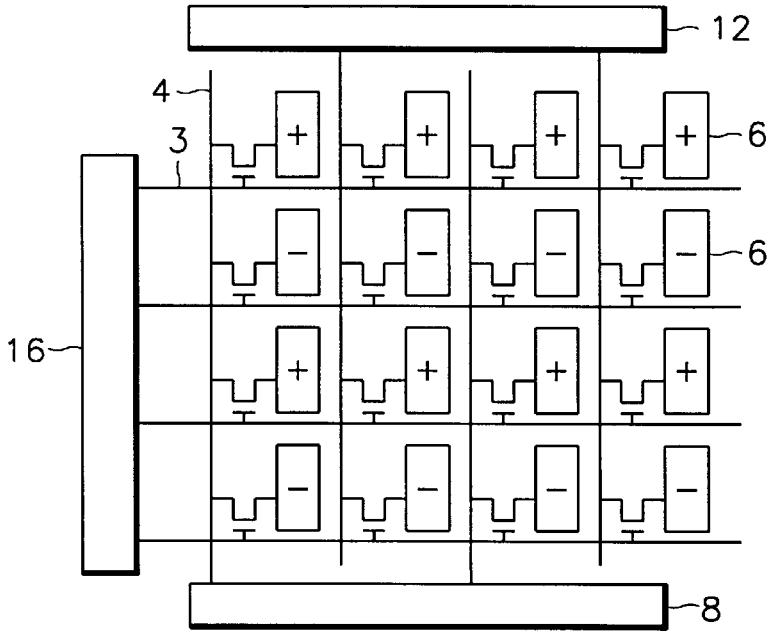
FIG. 2 (Prior Art)
FIG. 2 is a circuit diagram illustrating an array of pixels in a conventional liquid crystal display device.
Figure 3:
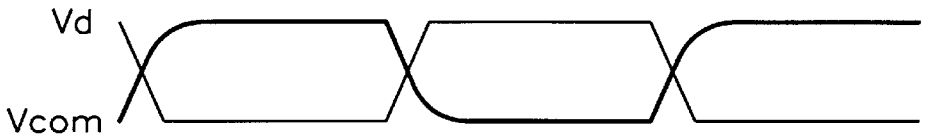
FIG.3 (Prior Art)
FIG. 3 illustrates a data voltage waveform representing black data applied in the conventional device illustrated in FIG. 2.
Figure 4:
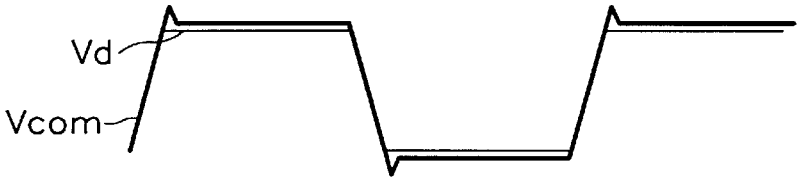
FIG.4 (Prior Art)
FIG. 4 illustrates a data voltage waveform representing white data applied in the conventional device illustrated in FIG. 2.
Figure 5:
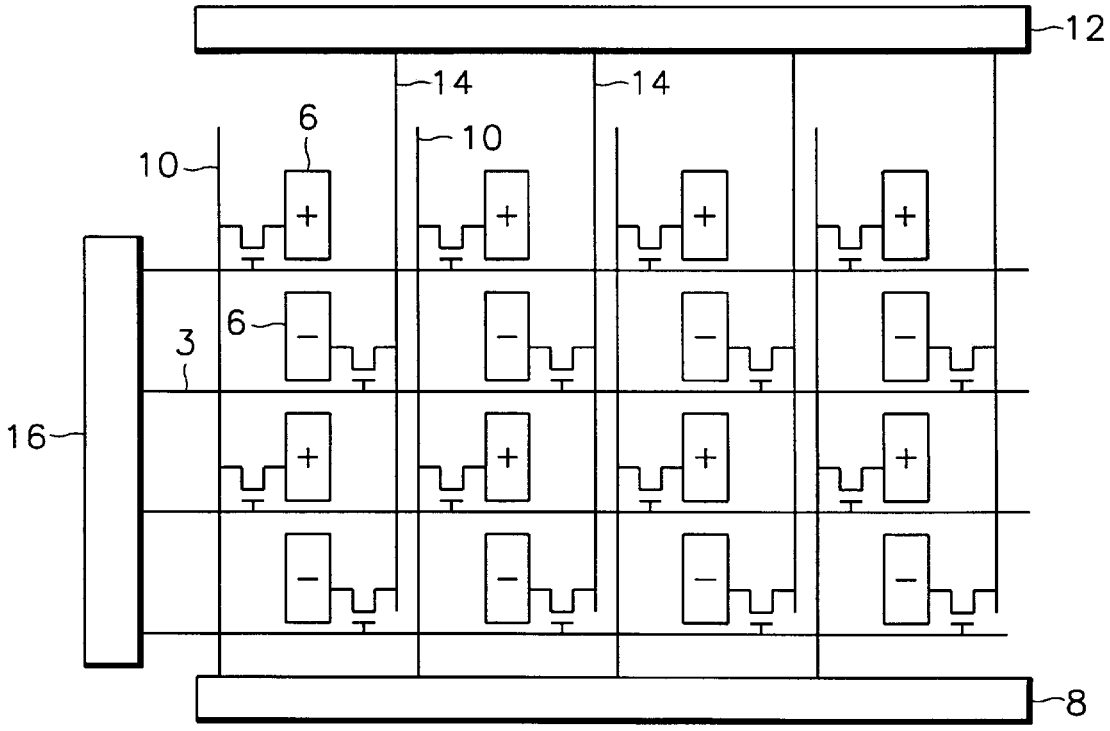
FIG. 5 is a circuit diagram illustrating an array of pixels of an embodiment of a liquid crystal display device according to the present invention.

FIG. 5 is a circuit diagram of an embodiment of a liquid crystal display according to the present invention. As shown, the display includes: an array of pixels 6 arranged in a matrix form of rows and columns; a gate line driver connected to gate lines 3, each of which is commonly connected to all pixels in its corresponding row; a first data driver 8 connected with first data lines 10, each of which is commonly connected to the ith (i=1, 3, 5, . . . ) row of pixels in its corresponding column; a second data driver 12 connected with second data lines 14, each of which is commonly connected to the (i+1)th row of pixels in its corresponding column.

To drive the liquid crystal display device as described above, only the polarity of the common electrode voltage applied to each row must be inverted, and not that of the data voltage, as required in the conventional display.

In accordance with a gate drive signal generated by the gate driver 16, a video signal from the corresponding data driver is applied to a relevant pixel. For example, when a video signal is applied from the first data driver 8 through the first data line 10 to a pixel in the first row, the common electrode voltage (Vcom) is in the lowest state, 0 V, and the video signal voltage (Vd) is in the range of 0–5 V. Further, when a video signal relevant to a pixel in the second row is transferred from the second data driver 12 to the pixel through the second data line 14, the common electrode voltage (Vcom) is in the highest state, 5 V, and the video signal voltage (Vd) is in the range of 0–5 V.

In this manner, each pixel in a row is driven one at a time, while the first data driver and the second data driver generate data signals having opposite polarity from each other with respect to the same gray level.

Figure 6:
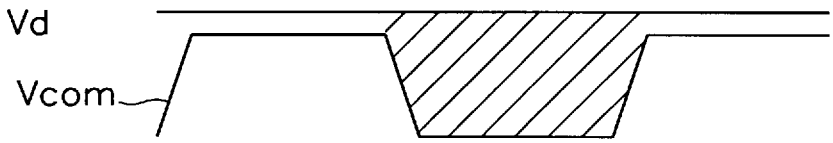
FIG. 6 illustrates a data voltage waveform representing black data applied by the first data driver in the device of FIG. 5.
Figure 7:
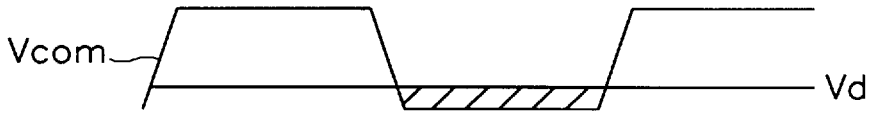
FIG. 7 illustrates a data voltage waveform representing white data applied by the first data driver in the device of FIG. 5.

As illustrated in FIG. 6 and FIG. 7, the gray level voltage corresponding to black and white data, respectively, as applied by the first data driver, is higher than that of the common electrode voltage (Vcom) and its range is between 0 V and 5 V.

Figure 8:
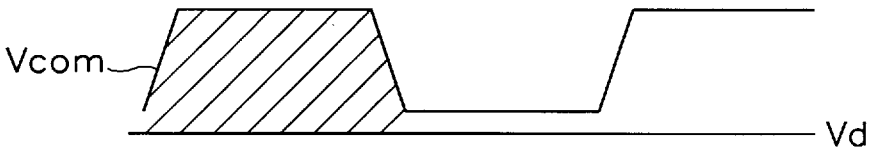
FIG. 8 illustrates a data voltage waveform representing black data applied by the second data driver in the device of FIG. 5.
Figure 9:
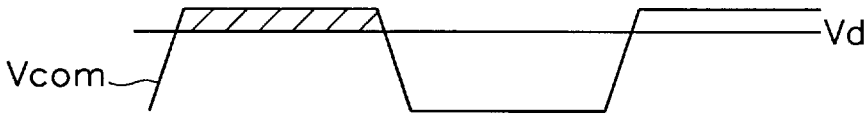
FIG. 9 illustrates a data voltage waveform representing white data applied by the second data driver in the device of FIG. 5.

As further illustrated in FIG. 8 and FIG. 9, the gray level voltage corresponding to black and white data, respectively, as applied by the second data driver, is lower than that of the common electrode voltage (Vcom) and its range is between 0 V and 5 V.

Accordingly, the data drivers 8 and 12 in the present invention transmit data voltage to the pixels in a stable manner, without requiring inversion as in the conventional display. Therefore, the common voltage (Vcom) can be protected from fluctuating up or down and the occurrence of horizontal crosstalk can be reduced to a minimum, even when using the gate line inversion driving method. Furthermore, the display according to the present invention can employ a low voltage data driver requiring driving voltages less than 5 V, thereby reducing power consumption.

Although the present invention has been herein described with reference to the preferred embodiment thereof, those skilled in the art will readily appreciate that various modifications and substitutions can be made thereto, without departing from the spirit and scope of the invention as set forth in the appended claims.

We claim:

1. A liquid crystal display comprising:

a plurality of gate lines which are connected to a gate driver and which include odd gate lines and even gate lines;

a plurality of first data lines which are connected to a first source driver and which are separated from each other;

a plurality of second data lines which are connected to a second source driver and which are arranged parallel to the first data lines;

a plurality of thin film transistors, each connected to one of the gate lines and one of the first and the second data lines; and a plurality of pixel electrodes, each connected to one of the thin film transistors and formed in an area defined by the gate lines and the first or the second data lines;

wherein one of the first data lines is adjacent to a first side of the pixel electrode and one of second data lines is adjacent to a second side of the pixel electrode opposite the first side, and wherein the odd gate lines are connected only to the thin film transistors connected to the first data lines and the even gate lines are connected only to the thin film transistors connected to the second data lines.

2. The liquid crystal display according to claim 1, wherein signals transmitted by the first data lines are of opposite polarity to signals transmitted by the second data lines.

3. The liquid crystal display of claim 2, wherein the polarities of signals transmitted by the first and the second data lines vary periodically.

* * * * *